US007764806B2

(12) United States Patent
Pei et al.

(10) Patent No.: US 7,764,806 B2
(45) Date of Patent: Jul. 27, 2010

(54) SPEAKER SET WITH ACOUSTICALLY VENTED ENCLOSURES

(75) Inventors: Hsien-Sheng Pei, Tu-Cheng (TW); Tsung-Lung Yang, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 982 days.

(21) Appl. No.: 11/309,348

(22) Filed: Jul. 28, 2006

(65) Prior Publication Data

US 2007/0127758 A1 Jun. 7, 2007

(30) Foreign Application Priority Data

Dec. 2, 2005 (TW) ..... 94142465 A

(51) Int. Cl.
*H04R 1/02* (2006.01)
*H04R 1/20* (2006.01)

(52) U.S. Cl. ..... 381/335; 381/345; 381/349; 381/351

(58) Field of Classification Search ..... 381/351, 381/335
See application file for complete search history.

(56) References Cited

U.S. PATENT DOCUMENTS 3,688,864 A * 9/1972 Guss ..... 381/89
5,657,392 A * 8/1997 Bouchard ..... 381/332
D518,817 S 4/2006 Ching
7,095,867 B2 * 8/2006 Schul et al. ..... 381/334
7,418,104 B2 * 8/2008 Spinale ..... 381/87

FOREIGN PATENT DOCUMENTS

WO 2005112504 A1 11/2005

* cited by examiner

*Primary Examiner*—Curtis Kuntz
*Assistant Examiner*—Matthew Eason
(74) *Attorney, Agent, or Firm*—Jeffrey T. Knapp

(57) ABSTRACT

A speaker set (10) includes an enclosure (11) extending two spaced supporting portions (118) from a bottom side thereof for contacting with a supporting member (20); a woofer (12), two mid-frequency speakers (13), and two tweeters (14) are disposed in the enclosure; a circuitry electrically connects with the woofer, the mid-frequency speakers, and the tweeters; two woofer chambers (121, 123) are disposed at two opposite sides of a diaphragm of the woofer. One of the woofer chambers is defined between the bottom side of the enclosure, the supporting portions of the enclosure and the supporting member, whilst the other one of the woofer chambers is defined in the enclosure. Sound generated by the woofer emanates to a surrounding environment through both the woofer chambers, wherein the enclosure defines a plurality of venting holes (122) communicating with the other one of the woofer chambers.

10 Claims, 5 Drawing Sheets

SPEAKER SET WITH ACOUSTICALLY VENTED ENCLOSURES

FIELD OF INVENTION

The present invention relates generally to electronic device audio systems, and more particularly to a speaker set having compact size and good sound quality.

DESCRIPTION OF RELATED ART

Portable electronic devices, such as notebooks, CD players, MP3s and the like, have decreased both in size and weight over the past few years and are becoming ever more popular with travelers. This demand for smaller size with ever-increasing capability has required a tremendous effort to continually shrink many of the components contained within the device.

For a notebook computer, examples of component shrinkage are the hard disk storage, the circuitry, tracking devices, compact disc drives, speakers, and even the connectors. The reduction in the size of many of these components has not been led to any serious problems, since technological advancements have allowed both improved capabilities along with smaller size. However, portable electronic devices being designed today require the ability to operate with multi-media features and provide the user with the same enjoyable experience as that experienced with conventional high quality desktop systems. Thus, the sounds emanating from a portable electronic device should provide as full a harmonic content as the original sounds. The production of low frequency sounds requires the movement of a large mass of air. As the speaker is reduced in size, the maximum power the speaker can handle is also reduced, resulting in both a reduction in loudness as well as a poorer overall quality of sound. However, increasing the device size to accommodate larger loudspeakers and larger speaker-box sizes is very undesirable since it would strongly detract from the very characteristics that have helped to make these devices popular, namely size and weight. Thus the size is at odds with high capability sounds of the speaker.

Therefore, there is a need for a speaker set which has smaller size and good sound quality.

SUMMARY OF THE INVENTION

The present invention relates to a speaker set for electronic components. According to a preferred embodiment of the present invention, the speaker set includes an enclosure extending two spaced supporting portions from a bottom side thereof for contacting with a supporting member. A woofer, two mid-frequency speakers and two tweeters are disposed in the enclosure. A partition plate is formed by the enclosure to divide a space in the enclosure into first and second chambers, wherein the mid-frequency speakers and the tweeters are received in the first chamber while the woofer is received in the second chamber. A circuitry electrically connects with the woofer, the mid-frequency speakers and the tweeters. Two woofer chambers are disposed at two opposite sides of a diaphragm of the woofer. One of the woofer chambers is defined between the bottom side of the enclosure, the supporting portions of the enclosure and the supporting member, whilst the other one of the woofer chambers is defined by the second chamber and venting holes defined in the enclosure and communicating with the second chamber. A portion of sound generated by the woofer emanates to surrounding environment via the venting holes.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present invention can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
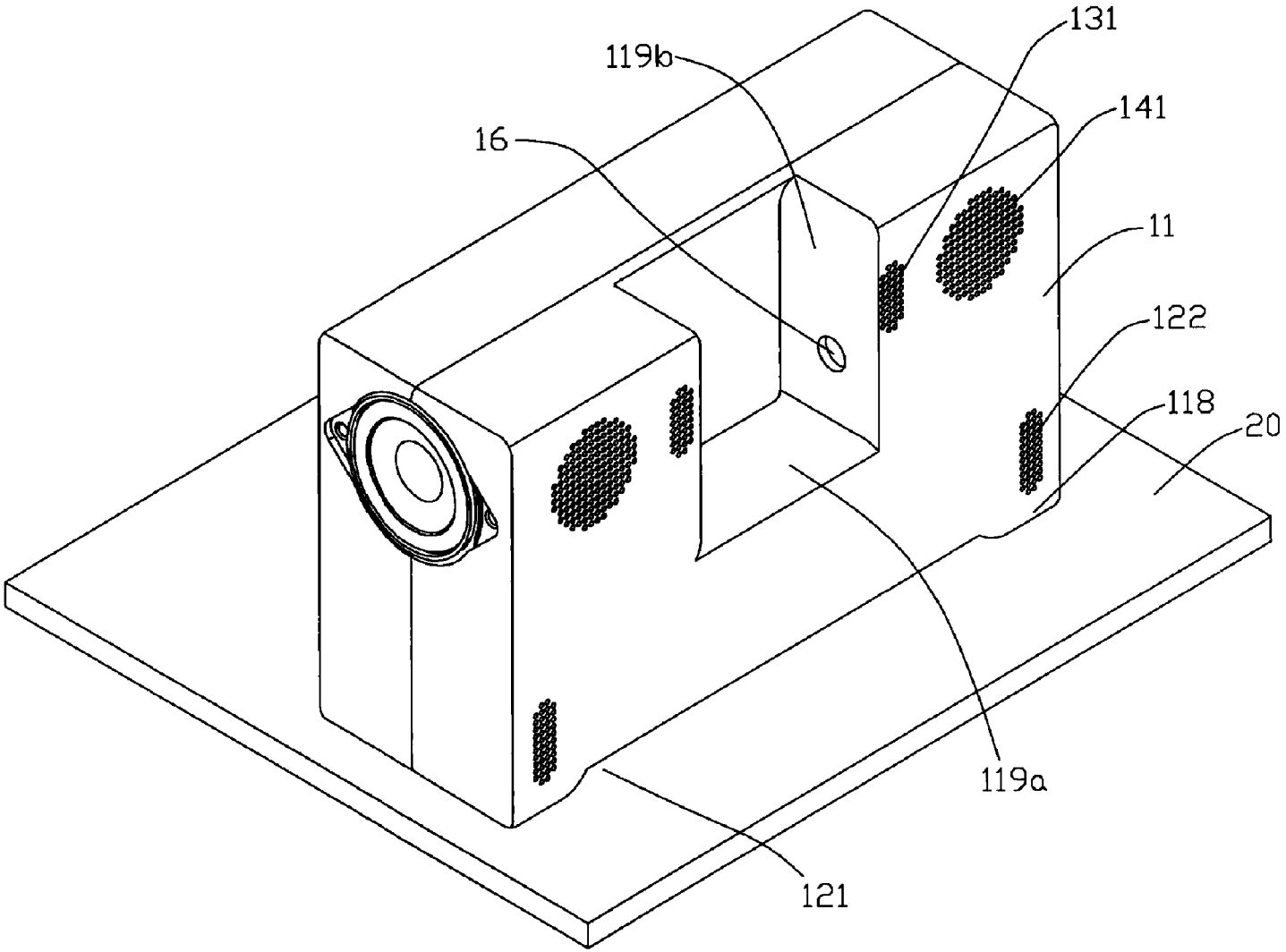
FIG. 1 is an assembled view of a speaker set according to a preferred embodiment of the present invention.
Figure 2:
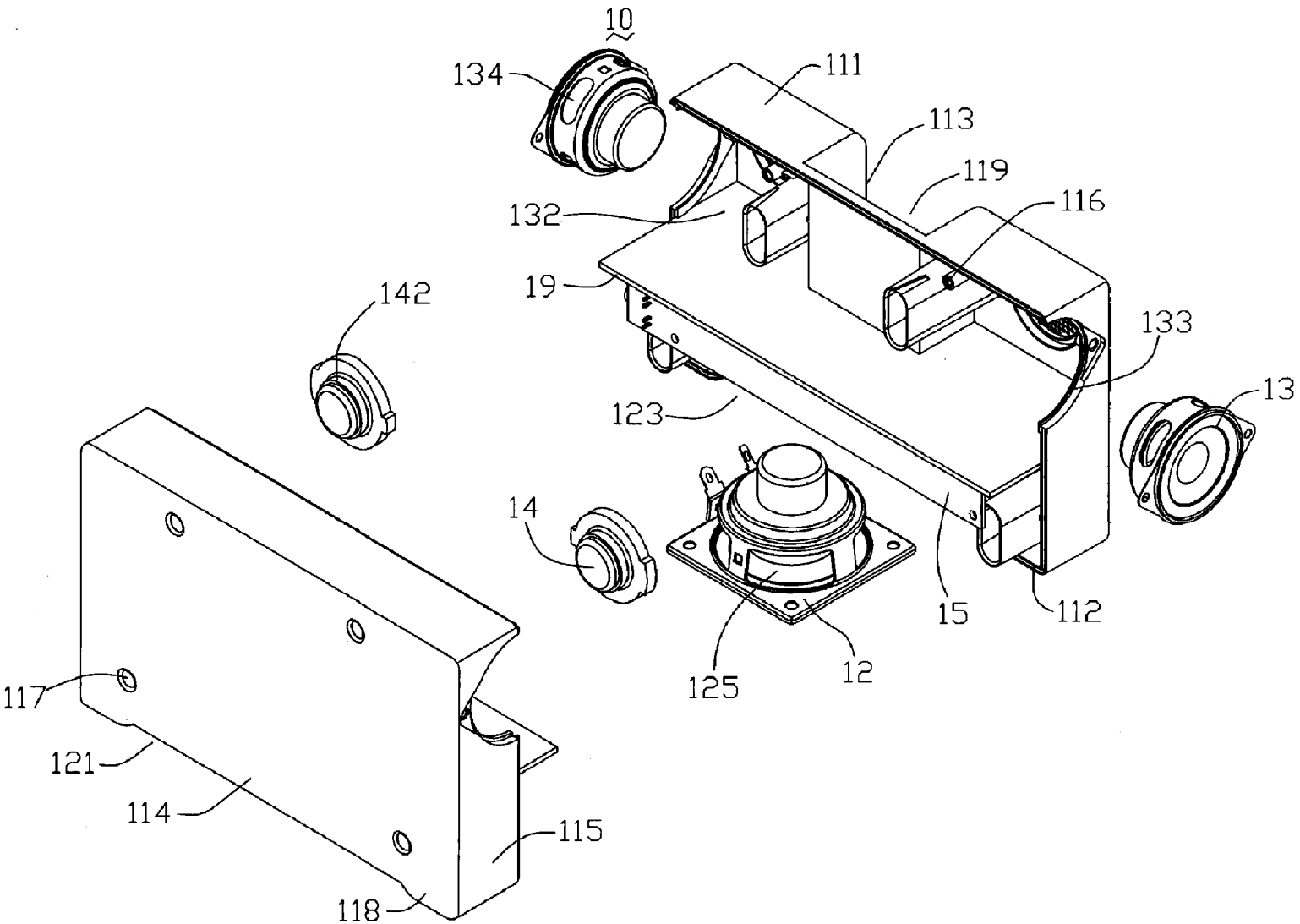
FIG. 2 is an exploded, isometric view of FIG. 1.
Figure 3:
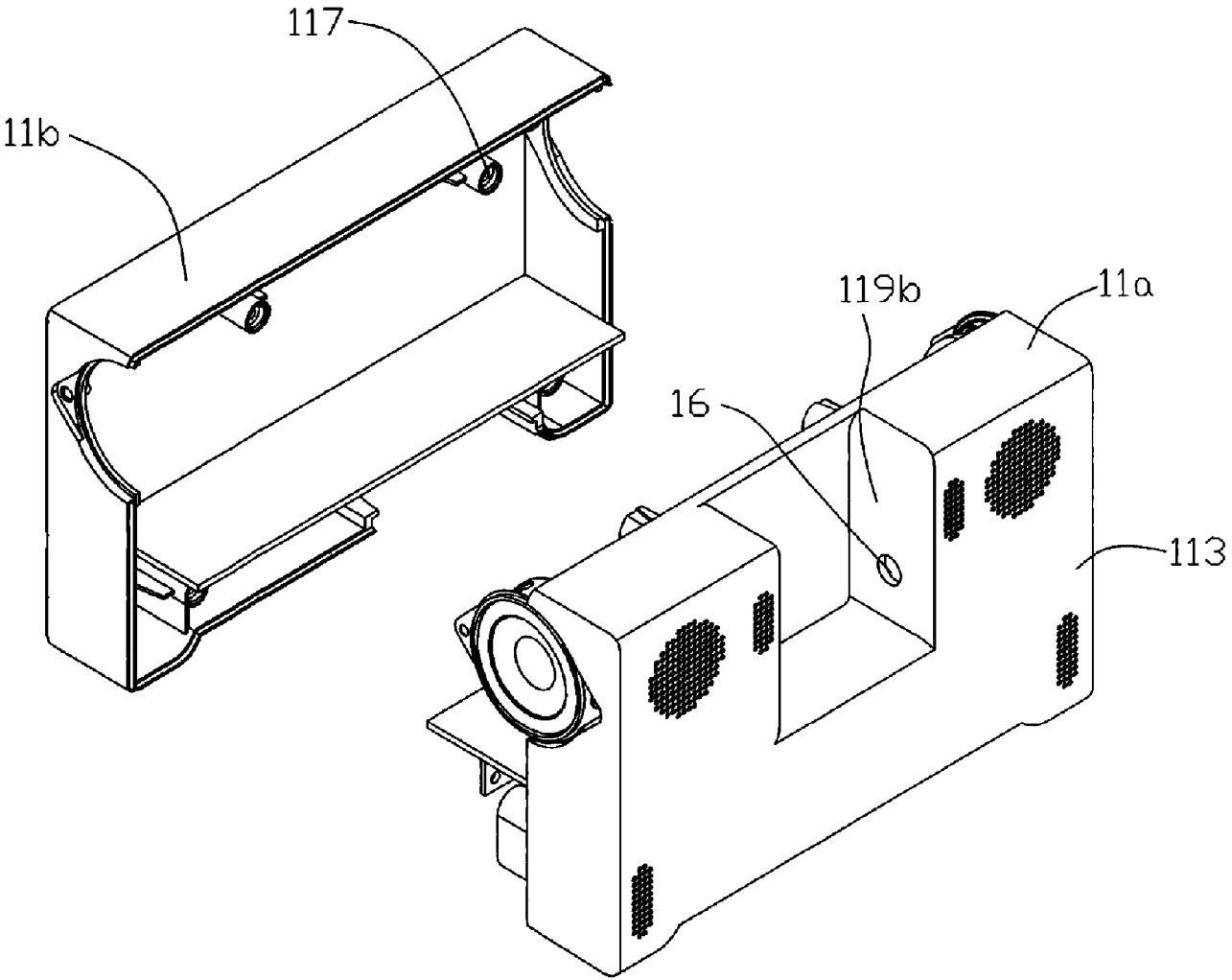
FIG. 3 is a partly assembled view of FIG. 1.

Referring to FIGS. 1 and 2, a speaker set 10 according to a preferred embodiment of the present invention is shown. The speaker set 10 includes an enclosure 11, three varieties of loudspeakers (i.e. a woofer 12 for providing low-frequency sounds, two mid-frequency speakers 13 for providing mid-frequency sounds, and two tweeters 14 for providing high-frequency sounds) disposed in the enclosure 11, and a circuit board 15 connected with the loudspeakers 12, 13, 14.

The enclosure 11 is a cuboid in profile, and is enclosed by two sections, i.e. a front enclosure 11*a* and a rear enclosure 11*b* coupled with the front enclosure 11*a*. The front enclosure 11*a* is enclosed by a front plate 113, a first top plate (not labeled), a first bottom plate (not labeled), and two first lateral plates (not labeled), whilst the rear enclosure 11*b* is enclosed by a rear plate 114, a second top plate (not labeled), a second bottom plate (not labeled), and two second lateral plates (not labeled). The first top, first bottom, and first lateral plates of the front enclosure 11*a* respectively join with the second top, second bottom, and second lateral plates of the rear enclosure 11*b* to cooperatively form a top plate 111, a bottom plate 112, and two lateral plates 115 of the enclosure 11. The front plate 113 of the front enclosure 11*a* has four projections 116 extending towards the rear plate 114 of the rear enclosure 11*b*, with four threaded holes (not labeled) respectively defined in free ends of the projections 116. The rear plate 114 defines therein four openings 117 aimed at the threaded holes of the projections 116. Four screws (not shown) extend through the openings 117 of the rear plate 114 and are engagingly screwed in the threaded holes of the projections 116 of the front plate 113 to couple the rear enclosure 11*b* with the front enclosure 11*a*.

The bottom plate 112 of the enclosure 11 has two legs 118 (supporting portions) which extend downwardly from two opposite ends thereof. The enclosure 11 is laid on a supporting member 20 such as a table, or the ground, with bottom surfaces of the legs 118 of the enclosure 11 contacting with a top surface of the supporting member 20. A bottom surface of the bottom plate 112 of the enclosure 11 is separated by a distance from the top surface of the supporting member 20, whilst inner surfaces of the legs 118 are spaced a distance from each other. A first woofer chamber 121 is defined between the top surface of the supporting member 20, the bottom surface of the bottom plate 112 of the enclosure 11, and the inner surfaces of the legs 118 of the enclosure 11.

The front plate 113 of the enclosure 11 defines a chamber 119 in a top portion thereof, for accommodating an acoustics electronic component (not shown) with a compact size, such as a mobile phone, a radio, a walkman or etc. The chamber 119 has a base wall 119*a* parallel to the bottom plate 112 of the enclosure 11, and two sidewalls 119*b* perpendicularly and upwardly extending from two opposite ends of the base wall 119*a*. One sidewall 119*b* of the chamber 119 defines a first input terminal 16 therein, which connects with an output terminal (not shown) of the acoustics electronic component to transmit electric sound signals generated by the acoustics electronic component towards the speaker set 10. Alternatively, the first input terminal may be defined in the base wall 119*a* of the chamber 119.

The front plate 113 of the enclosure 11 defines two groups of first vent holes 122 in a bottom portion thereof, and two groups of second and third vent holes 131, 141 in the top portion thereof. The first, second and third vent holes 122, 131, 141 respectively communicate the woofer 12, the mid-frequency speakers 13, and the tweeters 14 with the surrounding environment. The groups of the third vent holes 141 are symmetrically disposed at two opposite sides of the chamber 119; whilst each group of the second vent holes 131 is located between the chamber 119 and the adjacent group of the third vent holes 141, and is adjacent to the sidewalls 119*b* of the chamber 119. The groups of the first vent holes 122 are disposed adjacent to bottom and side fringes of the front plate 113. A distance between each of the side fringes of the front plate 113 and the adjacent group of the first vent holes 122 is smaller than a distance between each of the side fringes of the front plate 113 and the adjacent group of the third vent holes 141. Each group of the first and second vent holes 122, 131 is substantially rectangular shaped in profile, whilst each group of the third vent holes 141 is substantially round-shaped in profile. A diameter and a profile of each of the first, second and third vent holes 122, 131, 141 and a total area of each group of the first, second and third vent holes 122, 131, 141 can be configured for creating an improved audio quality of the speaker set 10.

Figure 5:
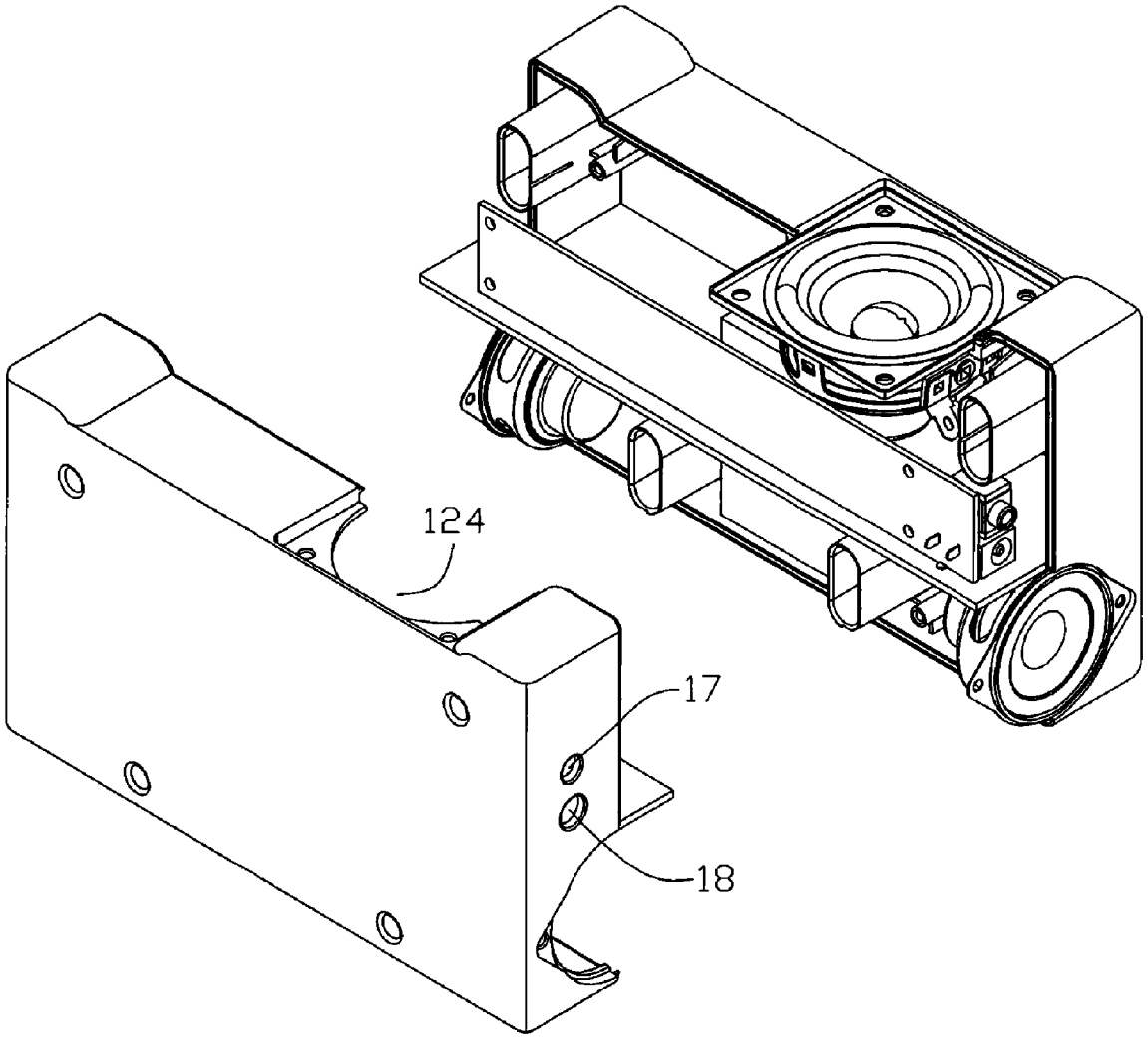
FIG. 5 is similar to FIG. 4, but turned through an angle of 180°.

Referring to FIG. 5, one of the lateral plates 115 of the enclosure 11 defines a second input terminal 17 therein for connecting a power supply (not shown) with the speaker set 10, and a third inlet terminal 18 for connecting the speaker set 10 with the compact acoustics electronic component via a data line (not shown). Furthermore, the acoustics electronic component connected with the speaker set 10 via the third inlet terminal 18 may be a large sized acoustical electronics component, such as a television, a DVD player, a personal computer, a notebook, etc. Therefore, the size of the electronic component connected with the speaker set 10 can not be limited due to the size of the chamber 119, which increases compatibility of the speaker set 10 for the electronic component.

Figure 4:
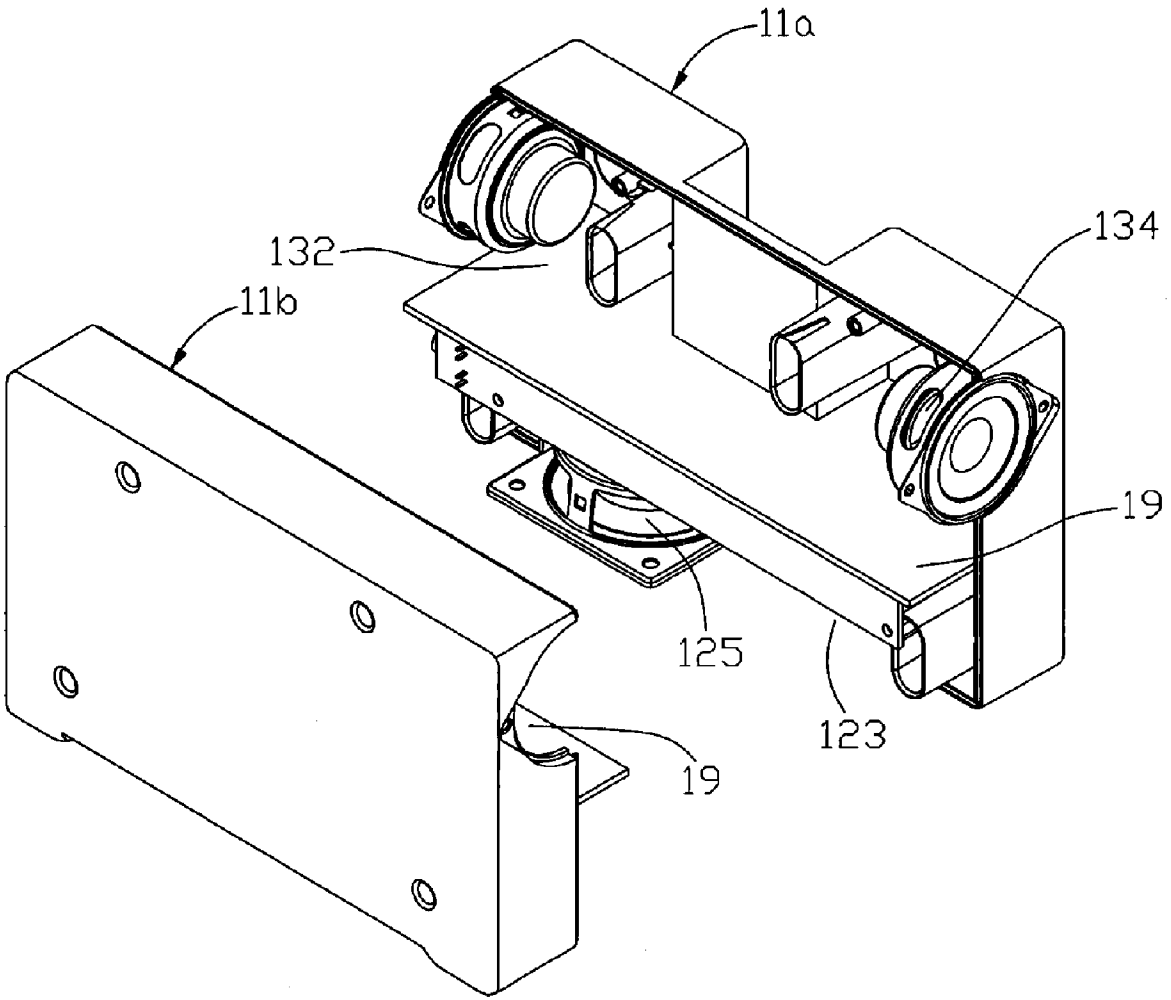
FIG. 4 is similar to FIG. 3, but viewed from another aspect.

Referring to FIG. 4, the front and rear plates 113, 114 of the enclosure 11 respectively extend a partition plate 19 towards each other from a middle thereof. The partition plates 19 interlace with each other to divide an inner space of the enclosure 11 into upper and lower spaces, i.e. a mid-frequency chamber 132, and a second woofer chamber 123. The woofer 12 is disposed in the second woofer chamber 123, whilst the mid-frequency speakers 13 and the tweeters 14 are disposed in the mid-frequency chamber 132.

The circuit board 15 is perpendicularly mounted to the partition plate 19 and disposed in the second woofer chamber 123. Circuitry (not shown) is arranged on the circuit board 15, which electrically connects the acoustics electronic component with the woofer 12, the mid-frequency speakers 13, and the tweeters 14. The circuitry amplifies and divides the electric sound signals provided by the acoustics electronic component into three kinds of signals in different frequency ranges, i.e. low-frequency, mid-frequency and high-frequency electric sound signals. The low-frequency, mid-frequency and high-frequency electric sound signals are transmitted to the woofer 12, the mid-frequency speakers 13, and the tweeters 14 via the circuitry. The woofer 12, the mid-frequency speakers 13, and the tweeters 14 convert electric signals in their respective frequency ranges into sound.

The woofer 12 is positioned in a first mounting hole 124 (FIG. 5) defined in the bottom plate 112 of the enclosure 11. The woofer 12 has a sound-generating oscillating diaphragm (not labeled), which communicates with the surrounding environment at a front side thereof, and defines three first through holes 125 in a rear side thereof. The first through holes 125 communicate the rear side of the woofer 12 with the second woofer chamber 123, which communicates with the surrounding environment via the first vent holes 122. The low-frequency sounds generated by oscillations of the diaphragm of the woofer 12 are therefore diffused towards the surrounding environment from the rear side thereof via the first through holes 125 of the woofer 12, the second woofer chamber 123, and the first vent holes 122. In addition, the low-frequency sounds are diffused towards the surrounding environment from the front side thereof via the first woofer chamber 121, which communicates the front side of the diaphragm of the woofer 12 with the surrounding environment.

Particularly referring to FIGS. 1 and 2, the mid-frequency speakers 13 are received in two second mounting holes 133 respectively defined in the lateral plates 115 of the enclosure 11 and positioned in the mid-frequency chamber 132. Each of the mid-frequency speakers 13 has a sound-generating oscillating diaphragm (not labeled) communicating with the surrounding environment at a front side thereof, and defines four second through holes 134 in a rear side thereof. The second through holes 134 communicate the rear side of the mid-frequency speakers 13 with the mid-frequency chamber 132, which communicates with the surrounding environment via the second vent holes 131. The mid-frequency sounds generated by the mid-frequency speakers 13 are therefore diffused towards the surrounding environment from the rear side thereof via the second through holes 134, the mid-frequency chamber 132, and the second vent holes 131. In addition, the mid-frequency sounds are directly diffused towards the surrounding environment from the front side thereof.

The tweeters 14 are received in the mid-frequency chamber 132, mounted directly behind the third vent holes 141 and communicate with the surrounding environment via the third vent holes 141. Each of the tweeters 14 has a sound-generating oscillating diaphragm (not labeled) communicating with the surrounding environment at a front side thereof, and a closed rear side 142 isolating the diaphragm from the mid-frequency chamber 132. The high-frequency sounds generated by the tweeters 14 are diffused towards the surrounding environment via the third vent holes 141 only.

In operation of the speaker set 10, the electric sound signals provided by the acoustics electronic component are transferred to the speaker set 10 via the connection between the first/third input terminal 16/18 of the speaker set 10 and the output terminal of the acoustics electronic component. The electric sound signals are amplified and divided into the low-frequency, mid-frequency and high-frequency electric sounds signals, and transmitted to the woofer 12, the mid-frequency speakers 13, and the tweeters 14. The low-frequency, mid-frequency and high-frequency electric sound signals drive the diaphragms of the woofer 12, the mid-frequency speakers 13, and the tweeters 14 respectively to oscillate to generate sounds in different frequency (i.e. the low-frequency, mid-frequency and high-frequency range). The low-frequency sounds are diffused towards the surrounding environment from the front side thereof via the first woofer chamber 121, and from the rear side thereof via the first through holes 125, the second woofer chamber 123, and the first vent holes 122. The mid-frequency sounds are diffused towards the surrounding environment directly from the front side thereof, and from the rear side thereof via the second through holes 134, the mid-frequency chamber 132, and the second vent holes 131. The high-frequency sounds are directly diffused towards the surrounding environment from the front side thereof via the third vent holes 141.

In the speaker set 10, the second woofer chamber 123 and the first vent holes 122 cooperatively form a Helmholtz resonance chamber (not labeled) with a low natural frequency. When the oscillations of the diaphragm of the woofer 12 are transferred to the Helmholtz resonate chamber, the air in the resonant chamber is driven to resonance with the resonant chamber at the natural frequency of the resonant chamber. The resonant frequency of the low-frequency sounds is decreased, which boosts the low-frequency sounds of woofer 12. Meanwhile, when the oscillations of the diaphragm of the woofer 12 are transferred to the first woofer chamber 121, the first woofer chamber 121 resonates with the air therein, and the low-frequency sounds of the woofer 12 are boosted. Therefore, the warmth of the low-frequency sound of speaker set 10 is increased. Similarly, the mid-frequency chamber 132 resonates with the air therein when the oscillations of the diaphragms are transferred thereto. The resonant frequency of the mid-frequency chamber 132 and the air therein is decreased, which increases the brightness of the mid-frequency sounds of the speaker set 10.

In the present invention, the low-frequency sounds are diffused towards the surrounding environment from the bottom plate 112 and the two opposite sides of the front plate 113 of the enclosure 11, the mid-frequency sounds are diffused towards the surrounding environment from the lateral plates 115 and the two opposite sides of the front plate 113 of the enclosure 11, whilst the high-frequency sounds are diffused towards the surrounding environment from the two opposite sides of the enclosure 11. These sounds are heard from different directions, and a stereo effect is therefore generated.

In the present invention, the woofer 12 has two resonant chambers, i.e. the first and second woofer chambers 121, 123. The first woofer chamber 121 is disposed between the speaker set 10 and the supporting member 20, which boosts the low-frequency sounds of the speaker set 10. As compared to a conventional speaker set with one woofer chamber, if the conventional speaker set has the same strength of the low-frequency sounds as that of the present speaker set 10, the woofer 12 of the present speaker set 10 needs a lower power to drive it than the conventional speaker set. A diameter of the woofer 12 is thus smaller than a woofer of the conventional speaker set. Therefore, the present speaker set 10 occupies a smaller room than the conventional speaker set. Furthermore, the present speaker set 10 includes three varieties of loudspeakers, i.e. the woofer 12, the mid-frequency speakers 13 and the tweeters 14 integrated into a single unit. The present speaker set 10 is more portable than a conventional combined speaker set having separate woofer, mid-frequency speaker, and tweeter in separate units.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of portions within the principles of the invention to the full extent indicated by the broad general meaning of the terms in which the appended claims are expressed.

What is claimed is:

1. A speaker set, comprising:

an enclosure comprising a side and a mid-frequency chamber, the side having two spaced supporting portions extending therefrom configured for contacting a supporting member;

a woofer, two mid-frequency speakers, and at least one tweeter disposed in the enclosure;

a circuitry electrically connected with the woofer, the at least one mid-frequency speaker, and the at least one tweeter; and two woofer chambers disposed at two opposite sides of a diaphragm of the woofer, wherein one of the woofer chambers is defined between the side of the enclosure, the supporting portions of the enclosure and the supporting member, and the other one of the woofer chambers is defined in the enclosure;

wherein the mid-frequency chamber is isolated from the other one of the woofer chambers; and wherein the mid-frequency speakers are disposed in the mid-frequency chamber respectively at two opposite sidewalls of the enclosure, and communicate with the mid-frequency chamber at one side of a diaphragm of each of the mid-frequency speakers, and a front side of the enclosure defines two groups of first vent holes respectively at two opposite sides thereof, communicating the mid-frequency chamber with the surrounding environment.

2. The speaker set as described in claim 1, wherein the one of the woofer chambers communicates the surrounding environment with one of the two opposite sides of the diaphragm of the woofer.

3. The speaker set as described in claim 1, wherein the woofer is mounted in the other one of the woofer chambers.

4. The speaker set as described in claim 3, wherein the other one of the woofer chambers communicates with the other one of the two opposite sides of the diaphragm of the woofer, and the enclosure further comprises a front side defining a plurality of second vent holes therein, communicating the other one of the woofer chambers with the surrounding environment.

5. The speaker set as described in claim 1, wherein the at least one tweeter comprises two tweeters disposed in the mid-frequency chamber respectively at two opposite sides of a front side of the enclosure, each of the tweeters comprises a closed side isolating a diaphragm thereof from the mid-frequency chamber, and the front side of the enclosure defines two groups of third vent holes therein, communicating one side of the diaphragm of each of the tweeters with the surrounding environment.

6. The speaker set as described in claim 5, wherein the first vent holes are located between the third vent holes.

7. A speaker set, comprising:

an enclosure having therein a lower first chamber and an upper second chamber isolated from each other;

a woofer mounted in the first chamber and facing downwardly;

a mid-frequency speaker mounted in the second chamber; and a tweeter is mounted in the second chamber;

wherein the enclosure further has two support portions extending downwardly from a bottom side thereof, and defines a group of first venting holes and a group of second venting holes, the support portions are for supporting the enclosure on a supporting member, a third chamber defined between the bottom side of the enclosure, the supporting member and the supporting portions of the enclosure, a portion of sound generated by the woofer emanating to a surrounding environment via the first venting holes through the first chamber and another portion of the sound generated by the woofer emanating directly downwardly to the surrounding environment via the third chamber, and a portion of sound generated by the mid-frequency speaker emanating to the surrounding environment via the second venting holes through the second chamber and another portion of the sound generated by the mid-frequency speaker emanating directly to the surrounding environment; and wherein the enclosure further defines a group of third venting holes through which sound generated by the tweeter emanates to the surrounding environment, the third venting holes located farther from a middle of the enclosure than the second venting holes.

8. The speaker set as described in claim 7, wherein the enclosure further defines a recess for receiving an acoustic electronic component, and sound generated by the acoustic electronic component is to be amplified by the mid-frequency speaker and the woofer of the speaker set.

9. The speaker set as described in claim 1, wherein the enclosure further comprises a front plate and a rear plate opposite to the front plate, the front and rear plates each comprise a partition plate extending towards each other, and the partition plates interlace with each other to divide an inner space of the enclosure into the mid-frequency chamber and the other one of the woofer chambers.

10. The speaker set as described in claim 1, wherein the enclosure further comprises a chamber configured for accommodating an acoustics electronic component therein, one side of the chamber defines an input terminal therein configured for connecting the speaker set with an output terminal of the acoustics electronic component to transmit electric sound signals generated by the acoustics electronic component towards the speaker set.

* * * * *